United States Patent [19]

Stiefel

[11] 4,066,262

[45] Jan. 3, 1978

[54] GAME TARGET FOR PROJECTILES

[76] Inventor: Arthur A. Stiefel, 5200 Gulf Drive, No. 207, Holmes Beach, Fla. 33510

[21] Appl. No.: 663,950

[22] Filed: Mar. 4, 1976

[51] Int. Cl.[2] ..... A63B 71/04

[52] U.S. Cl. ..... 273/105 R

[58] Field of Search ..... 273/101, 102 R, 102 S, 273/105 R, 105 A, 106 R, 181 F

[56] References Cited

U.S. PATENT DOCUMENTS

| | | | |
|---|---|---|---|
| 979,109 | 12/1910 | Underhill | 273/105 R |
| 1,528,661 | 3/1925 | Ewing | 273/102 R |
| 1,566,945 | 12/1925 | Winkley | 273/181 F |
| 2,147,502 | 2/1939 | Savage | 273/105 A UX |
| 3,328,033 | 6/1967 | Hendry | 273/105 A X |
| 3,692,072 | 9/1972 | Kohls | 273/105 R X |
| 3,814,150 | 6/1974 | Gower | 273/105 R X |

FOREIGN PATENT DOCUMENTS

| | | | |
|---|---|---|---|
| 435,996 | 1/1912 | France | 273/102 R |

*Primary Examiner*—Richard T. Stouffer
*Assistant Examiner*—Vance Y. Hum
*Attorney, Agent, or Firm*—Lowe, King, Price & Markva

[57] ABSTRACT

In a free standing target apparatus for playing cards, or other aerial projectiles, a bowl-shaped target is disposed above a backdrop of continuous sheeting material. The sheeting material slopes downwardly and converges at a receptacle located below the target. The slope of the sheeting material is steep enough to cause playing cards landing on the backdrop to slide downwardly into a stack in the receptacle. A notch is formed in the base of the receptacle, so that the stack of playing cards can be easily gripped by the player for removal. The front surface of the backdrop extends vertically to the floor to prevent misplayed cards from sliding beneath the target apparatus, and to prevent air currents from altering the trajectories of the cards. The frame of the apparatus is comprised of a plurality of straight tubing segments held together by molded sleeves. The frame can thus be easily disassembled for storage or shipment.

9 Claims, 5 Drawing Figures

GAME TARGET FOR PROJECTILES

BACKGROUND OF THE INVENTION

The present invention relates generally to recreational devices, and more particularly to a target for playing cards or other aerial projectiles including a receptacle for collecting and stacking misplayed cards.

Games involving flipping playing cards toward a target is particularly popular since no preparation is required, and it can be played indoors. Furthermore, the game can be played by both young and old alike. In practice, the cards sail along a somewhat unpredicable trajectory toward the target, and cards missing the target land on the floor. The misplayed cards must then be gathered from the floor of the playing area, usually on hands and knees, and reassembled into a stack. Sometimes the cards slide beneath the target. This obviously detracts from the game.

The degree of difficulty of landing a card in the target is a function of the height of the target. This is so since the lower the target, the higher the probability of misplaced cards "fluttering" downwardly into the target fortuitously. Accordingly, for the skilled player, it is desirable that the target be located relatively high.

Since playing cards are planar and lightweight, they are substantially affected by air currents in the playing area. In order to ensure consistent playing results, it is imperative that air current be minimized. This is typically done by closing off doors and windows in the playing area, but invariably, air currents enter the playing area and disturb the trajectory of the playing cards.

Accordingly, a primary object of this invention is to provide a target apparatus for aerial projectiles that eliminates the necessity of collecting and stacking scattered cards.

Another object is to provide a target for playing cards, or other aerial projectiles, wherein air currents in the playing area are minimized.

Still another object of the invention is to provide a target for playing cards, or other aerial projectiles, wherein misplayed cards are automatically collected and stacked.

A still further object is to provide a target for playing cards, or other aerial projectiles, wherein misplayed cards are prevented from sliding beneath the target.

Yet another object of the invention is to provide a target for playing cards or other aerial projectiles that is relatively high off the floor to reduce the chances of misplayed cards fluttering down into the target.

A still further object of the invention is to provide a target for playing cards, or other aerial projectiles, comprising a target receptacle disposed above a backdrop of sheeting material, wherein the sheeting material slopes downwardly and converges at a collection receptacle for automatically collecting and stacking misplayed cards.

An additional object of the invention is to provide a target apparatus for playing cards, or other aerial projectiles, wherein misplayed cards are automatically collected and stacked in a receptacle, and the stack is easily removed from the receptacle without dismantling the target apparatus.

Still other objects and advantages of the present invention will become readily apparent to those skilled in this art from the following detailed description, wherein I have shown and described only the preferred embodiment of the invention, simply by way of illustration of the best mode contemplated by me of carrying out my invention. As will be realized, the invention is capable of other and different embodiments, and its several details are capable of modifications in various obvious respects, all without departing from the invention. Accordingly, the drawings and description are to be regarded as illustrative in nature, and not as restrictive.

SUMMARY OF THE INVENTION

In accordance with the invention, a self-supporting target apparatus for playing cards, or other aerial projectiles, comprises a bowl-shaped target disposed over a backdrop of sheeting material. The target is supported by a stem extending through the backdrop to the floor. The backdrop is mounted on a frame and slopes downwardly, converging at a receptacle for collecting and stacking the cards. The slope of the backdrop is steep enough to overcome frictional resistance between the cards and the sheeting material, so that the cards slide down the backdrop into the receptacle.

At the front of the target apparatus, the backdrop extends vertically to the floor to prevent misplayed cards from sliding beneath the apparatus. This also assists in attenuating air currents flowing from the rear of the apparatus.

The sheeting material is preferably formed of a light, flexible plastic material, e.g., polyethylene or paper, that presents a smooth, unwrinkled surface as it slopes downwardly toward the receptacle. The continuous, non-porous surface prevents cards from binding up on the backdrop, and also prevents air currents from entering the playing area.

The frame is formed of a plurality of straight, tubular segments interconnected by molded sleeving. The backdrop is supported on the segments by a plurality of nipples that interconnect with grommets formed along the periphery of the backdrop. Alternatively, the backdrop may be attached to the frame segments with ring members.

The backdrop is bonded to the upper rim of the receptacle. The receptacle in turn is mounted to a pair of horizontal, tubular frame segments with mounting rods that interfit with the open ends of the frame segments. The receptacle is exposed through the front surface of the apparatus, and a portion of the front of the receptacle is cut away to expose the card stack. A notch is formed in the base of the receptacle to enable a player to grasp the stack of cards and remove it through the front of the apparatus.

The frame is easily disassembled by separating the tubular frame segments with respect to the sleeving. The entire apparatus is lightweight, and after use, can be disassembled and stored in compact form.

Accordingly, an additional object of the invention is to provide a target apparatus that is easily disassembled for storage or shipment.

It is a still further object to provide a target for playing cards, or other projectiles that is lightweight for handling and is economical.

DETAILED DESCRIPTION OF A PREFERRED EMBODIMENT

Figure 1:
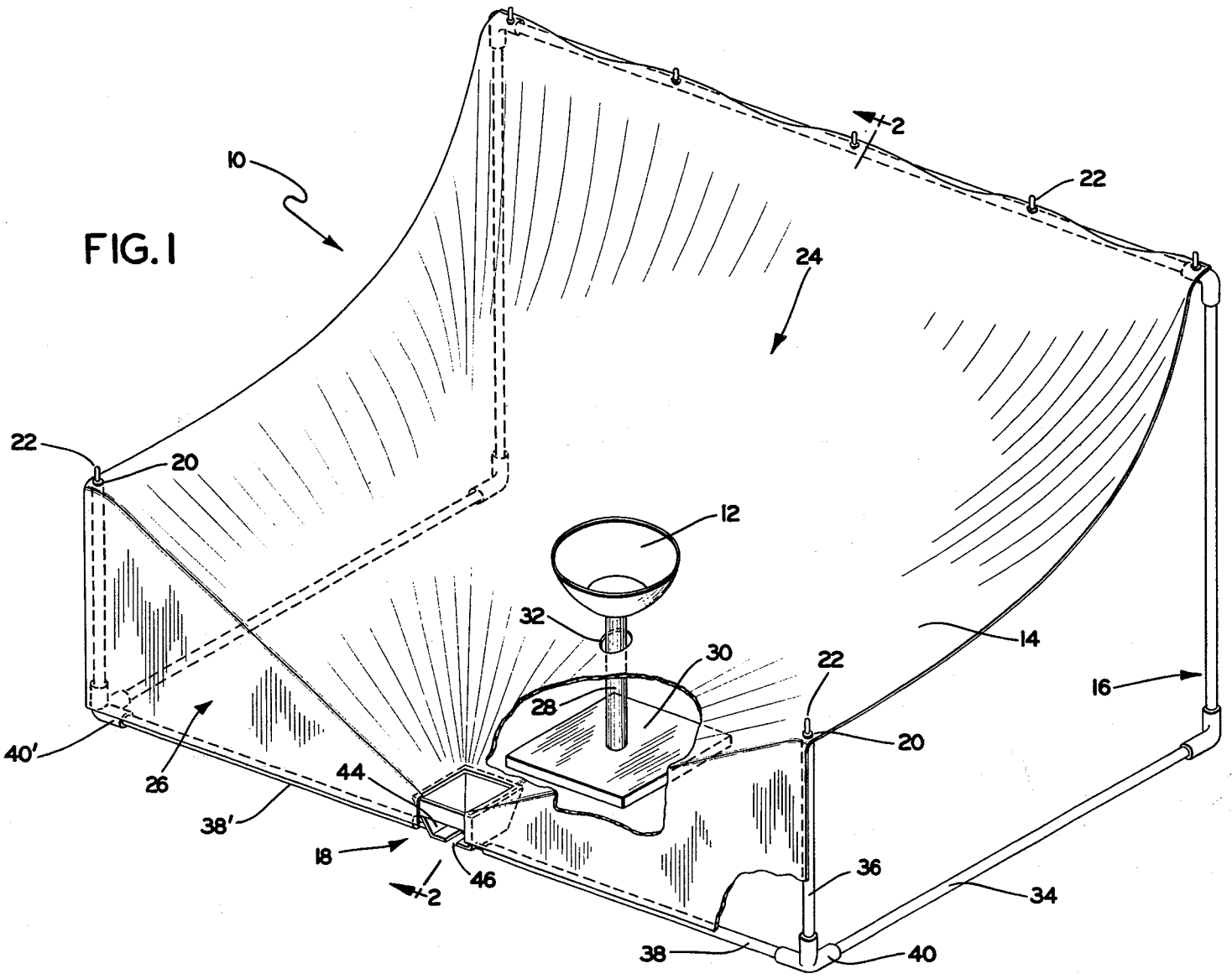
FIG. 1 is a perspective view of a target apparatus, in accordance with the invention, with portions cut away to show its construction.

Referring to FIG. 1, target appartaus 10 for playing cards or other aerial projectiles, in accordance with the invention, comprises a bowl-shaped target 12 disposed above a backdrop 14 of sheeting material 14. The backdrop 14 is supported by a floor-mounted frame indicated generally by numeral 16. Backdrop 14 is sloped downwardly, as shown, and converges at a receptacle 18. The slope of backdrop 14 is steep enough to cause playing cards that miss target 12 and land in the backdrop to slide downwardly into receptacle 18.

Figure 2:
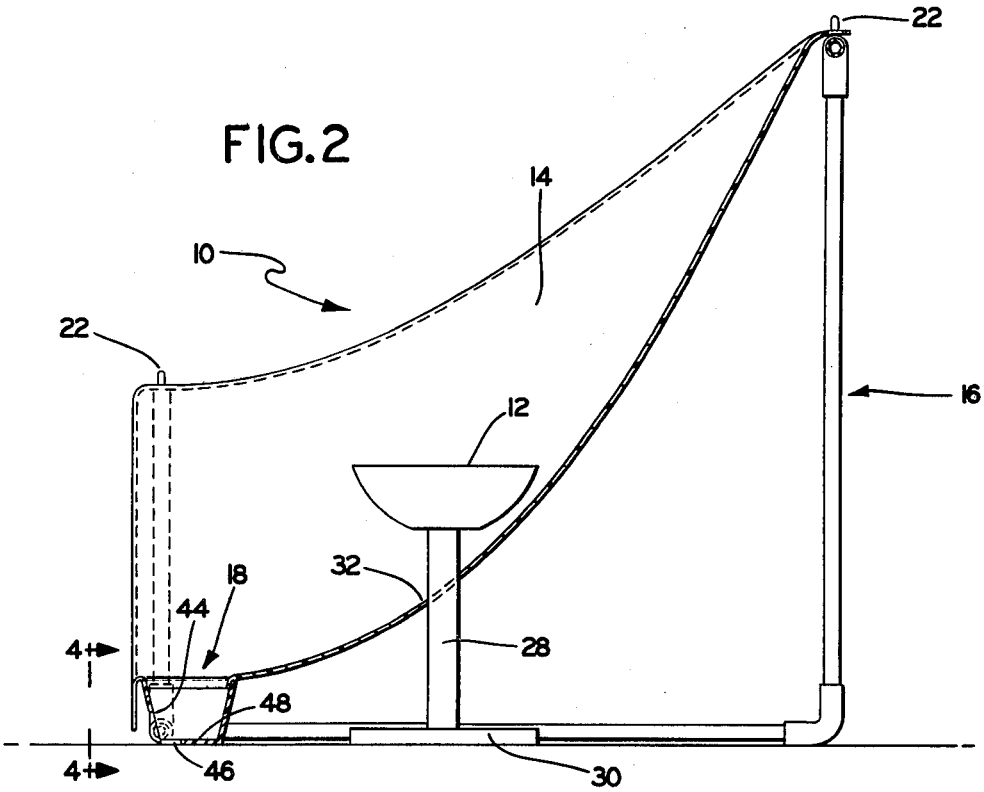
FIG. 2 is a cross-sectional side view of the target apparatus viewed along the lines 2—2 in FIG. 1.

Backdrop 14 is formed of a continuous sheeting material, such as polypropylene, that is non-porous and prevents air currents from interfering with the card trajectories in the vicinity of target 12. The periphery of the backdrop 14 contains a series of grommets 20 (see also FIG. 2) that interfit with vertical nipples 22 formed on the frame 16. The backdrop 14 completely surrounds target 12. The backdrop forms a closed upper surface 24 and front surface 26 of the apparatus 10; the sides and rear of the apparatus are open.

The sheeting material forming backdrop 14 is tapered to permit the backdrop to hang freely without wrinkling. Front surface 26 of the backdrop 14 extends vertically to the floor, as shown, to prevent misplayed cards from sliding underneath the apparatus 10.

The closed, front surface 26 of backdrop 14 also helps to block air currents flowing from the rear of the apparatus 10. Since the entire playing area in the region of target 12 is surrounded by continuous, non-porous sheeting material, air currents are prevented from entering the playing region and disturbing the trajectory of cards as they approach the target 12. This is especially important to ensure consistent playing conditions.

Figure 3:
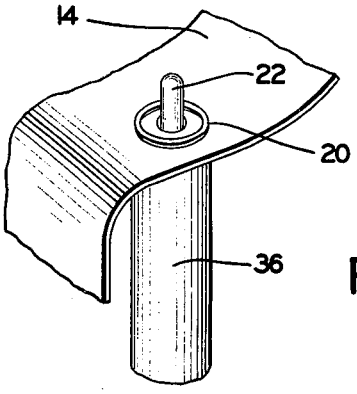
FIG. 3 is a front view of the receptacle viewed along the line 3—3 in FIG. 2.

Target 12, which is preferably a hemispherically-shaped bowl, is supported on the floor, by a stem 28 attached to a base 30 (see also FIG. 3). The stem 28 extends through an aperture 32 formed in backdrop 14, and is maintained above the backdrop within view of the players. The target 12 is positioned relatively high to minimize the number of misplayed cards fluttering down fortuitously into the target. The height of target 12 is determined by the length of stem 28, and could be higher or lower than that shown in FIG. 3, as desired.

Frame 16 is formed of a plurality of straight, tubular frame segments, such as segments 34, 36 and 38 (FIG. 1) interconnected by sleeving 40. The sleeving 40 is formed of a molded material, such as plastic, and maintains the frame segments 34, 36 and 38 orthogonal to each other. As aforementioned, the upper end of each vertical frame segment 36 contains a vertical nipple 22 that interfits with a grommet 20 in the backdrop 14.

Figure 4:
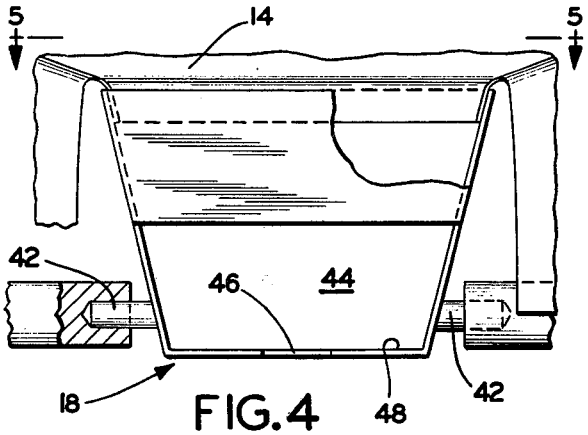
FIG. 4 is a top view of the receptacle viewed along the line 4—4 in FIG. 3.

The tubular construction of frame 16 contributes to the lightweight quality of the entire assembly 10, and makes the apparatus easier to disassemble for storage. Backdrop 14 is secured to the upper rim or mouth of receptacle 18 by any suitable means, such as by glueing (FIG. 4). A pair of connecting rods 38, secured to the sides of receptacle 18, interfit respectively with the open ends of frame segments 38 and 38'. The weight of the frame segments 38, 38', mounted to the floor at sleeving 40, 40', retains the receptacle 18 close to the floor and maintains backdrop 14 taut. This also eliminates any wrinkles in the backdrop 14, and ensures a steep slope to cause the playing cards to slide downwardly into the receptacle.

Figure 5:
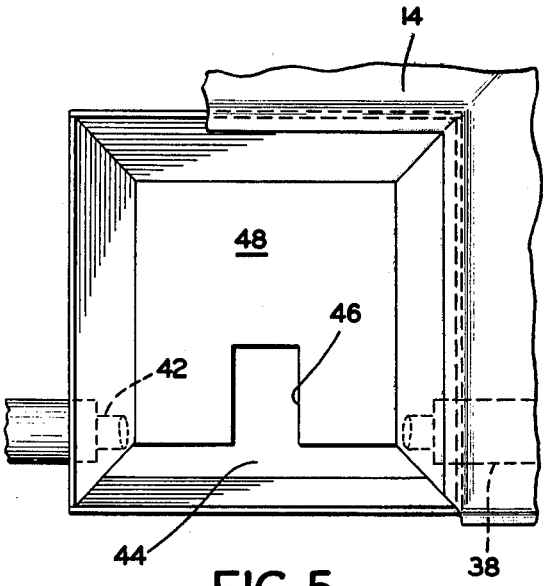
FIG. 5 is a detailed view of a portion of the backdrop mounted to a vertical frame member.

Referring to FIGS. 4 and 5, receptacle 18 has a square, horizontal cross-section, and is exposed to the players at the front surface 26 of the backdrop 14. A portion 44 of the receptacle 18 is cut away to expose playing cards stacked therein (not shown), and to permit the stack to be removed without dismantling the apparatus 10. A notch 46 is cut from the base 48 of receptacle 18 to enable the player to grip the top and bottom surface of the stack for removal through cutout 44 in the receptacle.

In use, players stand away from apparatus 10 at front surface 26 of backdrop 14, and flip playing cards one-by-one toward target 12. Each card that lands in target 12 earns the player a point. Cards missing the target 12 and landing on backdrop 14 slide downwardly along the backdrop into receptacle 18. The misplayed cards fall one on top of the other in receptacle 18 in a neat stack. After the entire deck has been played, the player merely places his hand into cut-out 44 in the receptacle 18, and grips the upper and lower surfaces of the stack, with his thumb or forefinger within the notch 46 (FIG. 5). The stack of cards is then easily removed from the front of the receptacle 18, and ready for another game.

In this disclosure, there is shown and described only the preferred embodiments of the invention, but, as aforementioned, it is to be understood that the invention is capable of use in various other combinations and environments and is capable of changes or modifications within the scope of the inventive concept as expressed herein. For example, although the description has been directed toward playing cards, obviously, other aerial projectiles such as tiles or irregular-shaped objects could be played. Furthermore, balls or marbles could be used by simply closing off cut-off 44 in receptacle 18 with a door. The door is simply opened at the end of play.

What is claimed is:

1. A game apparatus for receiving tossed playing cards, comprising:

a backdrop;

a quadrilateral collection receptacle having a mouth for collecting and stacking playing cards landing on said backdrop, said backdrop having a first aperture located at a lower, forward end portion thereof, said backdrop being downwardly sloped with the first aperture thereof being configured to and contiguous with said mouth of said receptacle;

said collection receptacle having an access opening at a front surface thereof, the access opening having a width corresponding to the width of a playing card;

a target for playing cards, said target being located above said receptacle and in proximity to said backdrop, an upper end of said backdrop extending above said target;

the slope of said backdrop being steep enough to overcome frictional resistance between said playing cards and said backdrop;

whereby playing cards passing above said target land on said backdrop and slide downwardly to be guided by said backdrop into said collection receptacle for removal as a stack through the access opening at the forward end portion of said backdrop.

2. The apparatus of claim 1, wherein said backdrop includes a second aperture located above said receptacle, said target extending through said second aperture to a support disposed beneath said backdrop.

3. The apparatus of claim 1, wherein said target is bowl-shaped.

4. The apparatus of claim 1, wherein a front surface of said backdrop extends vertically to the floor to block misplayed playing cards.

5. The apparatus of claim 1, wherein a base of said receptacle contains a notch for enabling removal of playing cards stacked in said receptacle through said front surface.

6. The apparatus of claim 1, including a frame formed of a plurality of frame segments, said frame segments being connected together with sleeving means.

7. The apparatus of claim 1, wherein said backdrop is formed of continuous sheeting to block out air currents with respect to said playing cards.

8. The apparatus of claim 7, including a plurality of ring members for mounting said sheeting to said frame.

9. The apparatus of claim 1, wherein said frame includes a pair of horizontal, tubular segments; and said receptacle includes a pair of mounting rods, said rods interfitting with said tubular segments for supporting said receptacle.

* * * * *